US006017109A

United States Patent [19]

Saijo

[11] Patent Number: 6,017,109

[45] **Date of Patent: *Jan. 25, 2000**

[54] INK JET APPARATUS

[75] Inventor: Yasutsugu Saijo, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,483

[22] Filed: Sep. 10, 1997

Related U.S. Application Data

[63] Continuation of application No. 08/365,736, Dec. 29, 1994, abandoned.

[30] Foreign Application Priority Data

Dec. 30, 1993 [JP] Japan ..... 5-354502

[51] Int. Cl.[7] ..... B41J 2/165

[52] U.S. Cl. ..... 347/30; 347/29; 347/22

[58] Field of Search ..... 347/29, 30, 31, 347/32, 24, 22

[56] References Cited

U.S. PATENT DOCUMENTS

| | | | |
|---|---|---|---|
| 4,586,058 | 4/1986 | Yamazaki et al. | 347/92 |
| 4,947,191 | 8/1990 | Nozawa et al. | 347/30 |
| 5,040,000 | 8/1991 | Yokoi | 347/30 |
| 5,210,550 | 5/1993 | Fisher et al. | 347/30 |

*Primary Examiner*—N. Le
*Assistant Examiner*—Thien Tran
*Attorney, Agent, or Firm*—Fitzpatrick, Cella, Harper & Scinto

[57] ABSTRACT

An ink jet apparatus includes an ink jet head, capping element and sucking element. The ink jet head includes a plurality of ink discharge openings each adapted to discharge ink therefrom and a common ink chamber communicated with the ink discharge openings for seeding ink to the ink discharge openings via an ink feeding port. The capping element serves as an element for covering the ink discharge openings of the ink jet head therewith and includes an ink suction port. In addition, the sucking element serves as an element for sucking ink from the ink discharge openings of the ink jet head via the ink suction port. The ink suction port is located at a position apart from a position opposing the ink feeding port of the ink jet head.

24 Claims, 11 Drawing Sheets

INK JET APPARATUS

This application is a continuation of application Ser. No. 08/365,736 filed Dec. 29, 1994, now abandoned.

BACKGROUND OF THE INVENTION

1. FIELD OF THE INVENTION

The present invention relates to an ink jet apparatus. In this specification, it should be construed that a word "recording" involves a technical concept of applying ink to a various kind of ink receiving medium such as cloth, thread, paper, sheet-like material and so forth each adapted to receive ink thereon to be printed, and that words "a recording apparatus" involve a technical concept defined by various kinds of information processing systems or a printer serving as an outputting system for each of the information processing system. The present invention can be applied to each of the information processing system and the printer as mentioned above

2. DESCRIPTION OF THE RELATED ART

A recording apparatus such as a printer, a copying machine, a facsimile or the like, or a recording apparatus usable as an outputting system for a composite type electronic system or a work station inclusive of a computer, a word processor or the like is constructed such that an image is recorded on a recording material (recording medium) such as a paper, a plastic sheet or the like based on given image information. An ink jet recording process for enabling each recording operation to be achieved with a high quality of recorded image at a high speed is employed in a recording apparatus of the foregoing type.

Generally, an ink jet apparatus includes an ink jet head which is substantially composed of a plurality of ink discharge openings arranged in the row-shaped pattern on a discharge opening surface, a common ink chamber communicated with the ink feeding ports for feeding ink to the ink discharge openings, and a tank portion having an ink feeding port formed thereon for feeding ink to the common ink chamber through the ink feeding port.

With respect to the ink jet apparatus including the ink jet head constructed in that way, there sometimes arises a malfunction that the viscosity of ink is increased due to evaporation of volatile components in ink through the ink discharge openings induced by the dry atmosphere or a similar factor while any recording operation is not performed with the ink jet apparatus with the result that merely incorrect ink discharge is achieved or any ink discharge can not be achieved with the ink jet apparatus. In this case, since it becomes difficult that ink is discharged from respective discharge openings, there arises another malfunction that a quality of recorded image is degraded.

To cope with the aforementioned malfunctions, discharge recovering treatment has been hitherto periodically conducted for the ink jet head irrespective of whether or not a recording operation is performed with the ink jet apparatus. In practice, an discharge recovering treatment unit substantially composed of a cap member for forming a closed space inclusive of a discharge opening plane while coming in tight contact with the discharge opening plane defined by a plurality of ink discharge openings of the ink jet head, a suction pump fitted to the cap member for bringing the closed space in the negative pressure state, and ink discharge openings for discharging ink discharged in the closed space by the suction force generated by the suction pump is used in order to conduct the foregoing type of discharge recovering treatment.

To facilitate understanding of the present invention, a typical conventional ink jet apparatus will be described below mainly in respect of a structure and a mode of operation of each of an ink jet head and an discharge recovering treatment unit with reference to FIG. 12 and FIG. 13.

FIG. 12 is a fragmentary sectional view of the conventional ink jet apparatus, showing the opened state that a capping unit is parted away from an ink jet head, and FIG. 13 is a fragmentary sectional view of the conventional ink jet apparatus similar to FIG. 12, showing the closed state that the capping unit is brought in tight contact with the ink jet head. Referring to FIG. 12, an ink jet head 1 is held in such a manner as to move in the direction perpendicular to the plane of the drawing with the aid of a moving mechanism and a holding mechanism each of which is not shown in the drawing. The ink jet head 1 includes a tank portion 1*a* in which ink Ik is fed by actuating a certain mechanism (not shown) so as to allow a certain amount of ink Ik to be storably received therein.

An ink feeding port 1*b* is arranged at the central part on the lower wall of the tank portion 1*a* so that the tank portion 1*a* is communicated with a common ink chamber 1*c* to be described later via the ink feeding port 1*b*. The common ink chamber 1*c* is located below the tank portion 1*a*. The common ink chamber 1*c* serve as an ink tank storing portion for feeding ink Tk in the tank portion 1*a* to all of ink discharge openings. In FIG. 12, reference numeral 1*d* designates a discharge opening plane which is defined by all the ink discharge openings, and reference numeral 1*e* designates a discharge opening group which is located in the vicinity of the ink feeding port 1*b*. The discharge opening group 1*c* is located at the central part as viewed from the standpoint of the whole ink discharge openings. In addition, reference numerals 1*f* and 1*g* designate discharge opening groups each of which is parted away from the ink feeding port 1*b*. Each of the discharge opening groups 1*f* and 1*g* is located at the end edge part as viewed from the standpoint of the whole ink discharge openings.

A peripheral wall portion 2*b* is formed along the peripheral edge portion of an upper surface 2*a* of a cap 2 serving as capping means in order to assure that a discharge opening plane 1*d* of the ink jet head 1 is thrusted by the peripheral wall portion 2*b* of the cap 2 along the whole peripheral edge thereof after the cap 2 is raised up by actuating a movable mechanism to be described later so as to come in tight contact with the discharge opening plane 1*d* of the ink jet head 1. The peripheral wall portion 2*b* of the cap 2 adapted to come in contact with the ink jet head 1 is molded of an elastic material such as a rubber or a similar material in consideration of conditions such as absorption of shock arising at the time of coming in contact with the ink jet head 1, improvement of the contact state after the foregoing time and so forth.

An ink suction port 2*c* is formed at the central part of the upper surface 2*a* of the cap 2, and an ink suction pipe 2*d* suspends from the ink suction port 2*c*. The lower end of the ink suction pipe 2*d* is connected to a suction pump 4 via a pipe 3 extending therebetween.

The cap 2 is held by a holder 5 capable of being displaced in the upward/downward direction with the aid of the movable mechanism (not shown). With this construction, it is possible to bring the cap 2 in tight contact with the discharge opening plane 1*d* of the ink jet head 1 or release the cap 2 from the tight contact state by actuating the movable mechanism.

In addition, an ink absorbing member 6 for absorbing ink Ik therein is placed on the upper surface 2*a* of the cap 2.

Next, a mode of suction recovering operation of the conventional ink jet apparatus constructed in that way will be described below.

First, as shown in FIG. 12, the ink jet head 1 is displaced to a home position by actuating a driving mechanism (not shown) so that the discharge opening plane 1*d* of the ink jet head 1 faces to the upper surface 2*a* of the cap 2 in the spaced relationship. Subsequently, the holder 5 is displaced in the upward direction by actuating the movable mechanism (not shown) so that the peripheral wall portion 2*b* of the cap 2 held on the holder 5 is brought in tight contact with the discharge opening plane 1*d* of the ink jet head 1 along the peripheral edge of the latter with a certain intensity of thrusting force, whereby the space in front of the discharge opening plane 1*d* of the ink jet head 1 becomes a closed space. When the suction pump 4 is driven, the pressure in the closed space becomes negative pressure. Thus, ink Ik in the tank portion 1*a* is sucked through the respective ink suction ports, causing ink having an increased viscosity and gas bubbles remaining in the respective ink suction ports and the common ink chamber 1*c* to be removably dislocated into the interior of the closed space. At the same time, ink Ik kept in the normal state is filled in the respective ink discharge openings from the common ink chamber 1*c*. As ink Ik is introduced into the closed space, it is absorbed in the ink absorbing member 6. Thereafter, ink Ik is displaced in the downward direction through the ink absorbing member 6, and finally, it is collected in a tank (not shown) via the ink suction pipe 2*d* and the pipe 3.

Next, after the closed space is released from the negative pressure state by actuating a negative pressure releasing mechanism such as a stop valve or the like (not shown) fitted to the cap 2, the driving of the suction pump 4 is interrupted, causing the holder 5 to be lowered until the cap 2 is parted away from the discharge opening plane 1*d* of the ink jet head 1, whereby a series of suction recovering operations are completed. It should be noted that the ink absorbing member is not shown in FIG. 13 for the purpose of simplification of illustration.

However, the conventional ink jet apparatus constructed in the above-described manner has the following drawback. Specifically, since the ink feeding port 1*b* of the ink jet head 1 and the ink suction port 2*c* of the cap 2 face to each other in the upward/downward direction, a manner of allowing Ink to flow through respective discharge openings at the central part of a row of ink discharge openings is different from that of allowing ink to flow through respective discharge openings at the peripheral part of a row of ink discharge openings. For this reason, an excellent quality of recorded image can not be maintained because the suction recovering state differs depending on the position occupied by each discharge opening group.

In more detail, as shown in FIG. 13, since ink remaining in the vicinity of the central discharge opening group 1*e* among a group of ink discharge openings is located around the line extending between the ink feeding port 1*b* and the ink suction port 2*c*, it is largely affected by a high intensity of sucking force. At this time, since the pressure loss induced by the ink absorbing member 6 interposed between the ink jet head 1 and the cap 2 is small, ink smoothly flows in the closed space at a high speed in the P arrow-marked direction as seen in the drawing, resulting in ink having an increased density and gas bubbles remaining in the discharge opening group 1e being removably dislocated from the latter at a high efficiency. On the contrary, since ink remaining in the vicinity of each of discharge opening groups if and 1*g* located along the end edge of a group of ink discharge openings is parted away from the line extending between the ink feeding port 1*b* and the ink suction port 2*c*, it is not largely affected by the suction force, and moreover, the pressure loss is relatively increased due to the presence of the ink absorbing member 6, ink slowly flows at a low speed in the R arrow-marked direction, resulting in ink having an increased viscosity and gas bubbles remaining in respective discharge openings in the discharge opening groups 1*f* and 1*g* failing to be removably dislocated to a sufficient extent.

As is apparent from the above description, as far as the conventional ink jet apparatus constructed in that way is concerned, uniform discharging properties can not be recovered with the whole discharge opening groups no matter how discharge recovering treatment is conducted for a group of ink discharge openings. This leads to the result that a density of recorded image fluctuates over the whole area of the latter, an moreover, and ink discharge is incorrectly achieved with the conventional ink jet apparatus, resulting in each recording operation being achieved at a high level of quality only with much difficulties. Especially, when the number of discharge openings is increased, the aforementioned malfunctions can remarkably be recognized.

SUMMARY OF THE INVENTION

The present invention has been made in consideration of the aforementioned background.

An object of the present invention is to provide an ink jet apparatus which is constructed such that uniform discharging properties can be recovered for all discharge openings after completion of discharge recovering treatment.

According to a first aspect of the present invention, there is provided an ink jet apparatus which comprises capping means for capping a plurality of ink discharge openings of an ink jet head therewith, the ink jet head including the plurality of ink discharge openings to downwardly discharge inks a common ink chamber communicated with the plurality of ink discharge openings, and an ink feeding port for feeding ink to the common ink chamber; and sucking means for sucking ink from the plurality of ink discharge openings of the ink jet head via an ink suction port while the ink jet head is capped by the capping means, the ink suction port being arranged at a position apart from a position opposing to the ink feeding port.

It may further comprise an ink flow restricting means for reducing a magnitude of resistance against the flowing of ink corresponding to the distance from the ink suction port, the ink flow restricting means being arranged in the capping means.

It may further comprise an ink absorbing member for absorbing ink, the ink absorbing member being arranged in the capping means.

Here, a degree of coarseness of the ink absorbing member may be increased in proportion to the distance from the ink suction port.

The ink jet head may include an energy generating element for generating energy to be utilized for discharging ink from the plurality of ink discharge openings.

Here, the energy generating element may be an electrothermal converting element for generating thermal energy for allowing a phenomenon of film boiling to appear in ink.

The plurality of ink discharge openings may be arranged in the row-shaped pattern across the whole width of an ink receiving medium to which is ink discharged from the plurality of ink discharge openings.

According to a second aspect of the present invention, there is provided an ink jet apparatus which comprises capping means for capping a plurality of ink discharge openings of an ink jet head therewith, the ink jet head including the plurality of ink discharge openings to downwardly discharge ink, a common ink chamber communicated with the plurality of ink discharge openings for feeding ink to the common ink chamber; and sucking means for sucking ink from the plurality of ink discharge openings of the ink jet head via an ink suction port while the ink jet head is capped by the capping means, wherein the ink suction port being arranged at a position where an image line connecting the ink suction port with the ink feeding port is crossed with almost all of extending lines along the discharge direction of ink discharged from the ink discharge openings, respectively.

Here, it may further comprise an ink flow restricting means for reducing a magnitude of resistance against the flowing of ink corresponding to the distance from the ink suction port, the ink flow restricting means being arranged in the capping means.

It may further comprise an ink absorbing member for absorbing ink, the ink absorbing member being arranged in the capping means.

Here, a degree of coarseness of the ink absorbing member may be increased in proportion to the distance from the ink suction port.

The ink jet head may include an energy generating element for generating energy to be utilized for discharging ink from the plurality of ink discharge openings.

Here, the energy generating element may be an electro-thermal converting element for generating thermal energy for allowing a phenomenon of film boiling to appear in ink.

The plurality of ink discharge openings may be arranged in the row-shaped pattern across the whole width of an ink receiving medium to which ink is discharged from the plurality of ink discharge openings.

According to a third aspect of the present invention, there is provided an ink jet apparatus which comprises capping means for capping a plurality of ink discharge openings of an ink jet head therewith, the ink jet head including the plurality of ink discharge openings to downwardly discharge ink, a common ink chamber communicated with the plurality of ink discharge openings, the chamber including an ink feeding port for feeding ink to the common ink chamber; sucking means for sucking ink from the plurality of ink discharge openings of the ink jet head via an ink suction port while the ink jet head is capped by the capping means, the ink suction port being arranged at a position apart from a position opposing to the ink feeding port; and a flow restricting means arranged in the capping means for reducing a magnitude of resistance against the flowing of ink corresponding to the distance from the ink suction port.

Here, the ink jet head may include an energy generating element for generating energy to be utilized for discharging ink from the plurality of ink discharge openings.

The energy generating element may be an electro-thermal converting element for generating thermal energy for allowing a phenomenon of film boiling to appear in ink.

The plurality of ink discharge openings may be arranged in the row-shaped pattern across the whole width of an ink receiving medium to which ink is discharged from the plurality of ink discharge openings.

According to a fourth aspect of the present invention, there is provided an ink jet apparatus which comprises capping means for capping a plurality of ink discharge openings of an ink jet head therewith, the ink jet head including the plurality of ink discharge openings to downwardly discharge ink, a common ink chamber communicated with the plurality of ink discharge openings, the an ink feeding port for feeding ink to the common ink chamber; sucking means for sucking ink from the plurality of ink discharge openings of the ink jet head via an ink suction port while the ink jet head is capped by the capping means, the ink suction port being arranged at a position apart from a position opposing to the ink feeding port; and an ink absorbing member for absorbing ink, whose a degree of coarseness being increased in proportion to the distance from the ink suction port.

Here, the ink jet head may include an energy generating element for generating energy to be utilized for discharging ink from the plurality of ink discharge openings.

The energy generating element may be an electro-thermal converting element for generating thermal energy for allowing a phenomenon of film boiling to appear in ink.

The plurality of ink discharge openings may be arranged in the row-shaped pattern across the whole width of an ink receiving medium to which ink is discharged from the plurality of ink discharge openings.

According to the present invention, since the ink suction port is not aligned with the ink feeding port but the former is positionally deviated from the latter, sucking force can uniformly be applied to all the ink discharge openings. This makes it possible to uniformalize the flowing of ink passing through respective discharge openings. Thus, since a sufficiently acceptable recovering state can be obtained over the whole range as seen in the direction of a row of discharge openings, an excellent quality of recorded image can be maintained with the ink jet apparatus.

The above and other objects, effects, features and advantages of the present invention will become apparent from reading of the following description on preferred embodiments thereof taken in conjunction with the accompanying drawings.

DESCRIPTION OF THE PREFERRED EMBODIMENTS

The present invention will now be described in detail hereinafter with reference to the accompanying drawings which illustrate preferred embodiments hereof.

[Embodiment 1]

Figure 1:
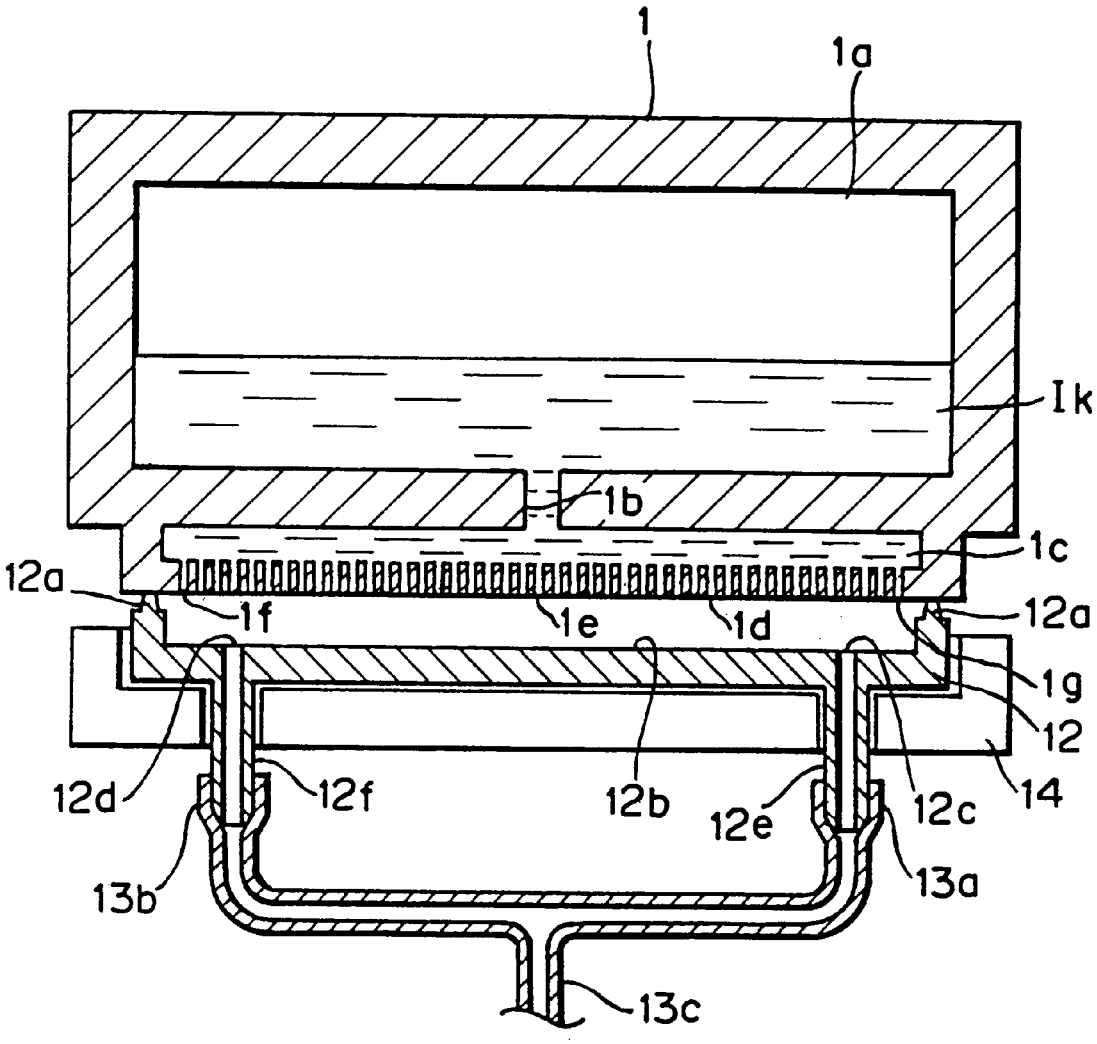
FIG. 1 is a fragmentary sectional view showing an ink jet head and capping means as essential elements in a first embodiment of an ink jet apparatus according to the present invention.
Figure 12:
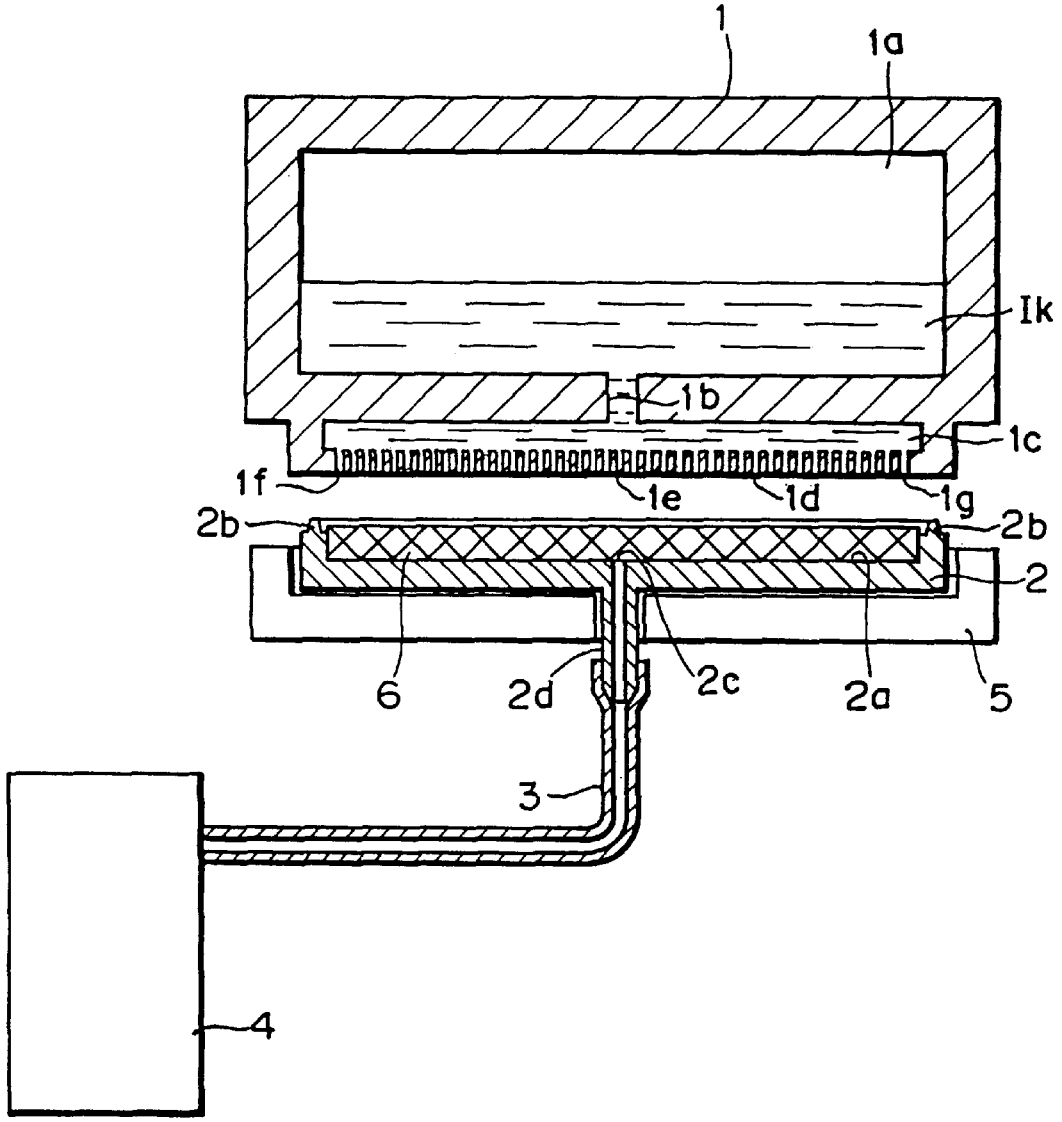
FIG. 12 is a fragmentary sectional view of a conventional ink jet apparatus, showing the opened state that capping means is parted away from an ink jet head so as to allow it to exhibit an opened contour.
Figure 13:
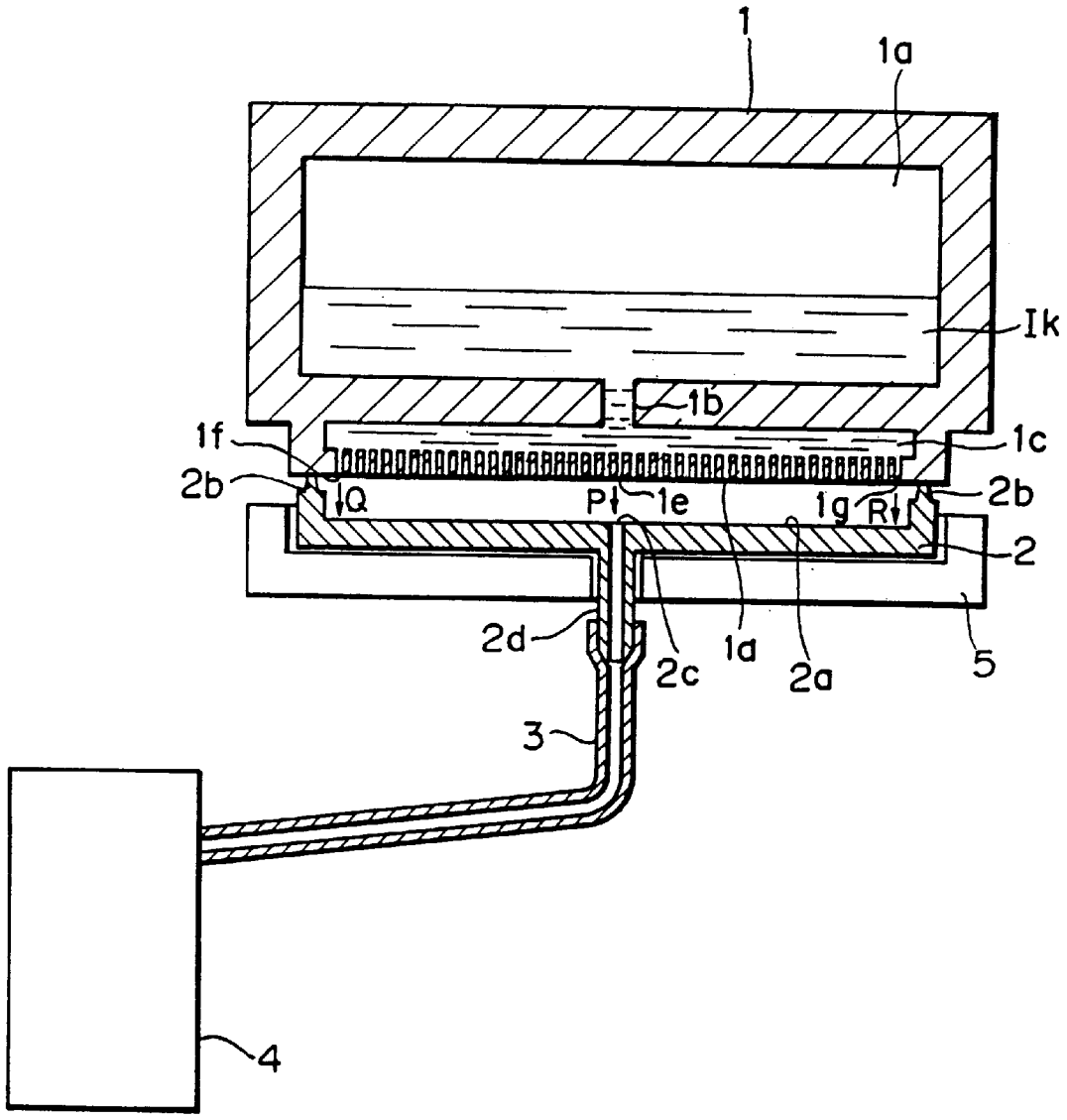
FIG. 13 is a fragmentary sectional view of the conventional link jet apparatus similar to FIG. 12, showing the closed state that the capping means is brought in tight contact with the ink jet head to form a closed space therebetween.

FIG. 1 is a sectional view of an ink jet apparatus constructed in accordance with a first embodiment of the present invention, showing the structure of an ink jet head and capping means constituting the ink jet apparatus as essential components. It should be noted that same components as those constituting an ink jet head and capping means in a conventional ink jet head shown in FIG. 12 and FIG. 13 are represented by same reference numerals and repeated description on these components is herein omitted for the purpose of simplification.

A characterizing feature of this embodiment consists in that two ink suction ports 12*c* and 12*d* are arranged at the positions substantially facing to a discharge opening group 1*f* and a discharge opening group 1*g* on the opposite end sides of a group of discharge ports of which central part faces to an ink feeding port 1*b*, and each of the ink discharge openings serves as to discharge ink in the downward direction. Referring to FIG. 1, at least a peripheral wall portion 12*a* of a cap 12 is molded of an elastic material, and a first ink suction port 12*c* and a second ink suction port 12*d* are formed on a substantially horizontally extending upper surface 12*b* of the cap 12. The first and second ink suction ports 12*c* and 12*d* are prepared in the form of opening portions at the upper ends of a first ink suction pipe 12*e* and a second ink suction pipe 12*f* both of which are communicated with a suction pump to be described later via a first pipe 13*a* and a second pipe 13*b*. As is apparent from the drawing, both the pipes 13*a* and 13*b* merge with a collective pipe 13*c* which extends to the suction pump. A holder 14 serves to hold the cap 12 thereon, and it can be displaced in the upward/downward direction by actuating a movable mechanism (not shown).

Next, description will be made below with respect to a mode of operation to be performed by the ink jet head 1 and the cap 12 constructed in that way during suction recovering treatment as well as suction recovering properties of the ink jet head 1 and the cap 12.

When the suction pump (not shown) is driven while the cap 12 shown in FIG. 1 is brought in tight contact with a discharge opening plane 1*d* of the ink jet head 1 with an adequate intensity of thrusting force, negative pressure arises in the closed space between the discharge opening plane 1*d* of the ink jet head 1 and the cap 12, causing ink Ik to be sucked into the closed space through respective discharge openings arranged in the row-shaped pattern. At this time, the distance as measured from the ink feeding port 1*b* to a central discharge opening group 1*e* is kept unchanged in contrast with the conventional ink jet apparatus but the distance from the ink feeding port 1*b* to the first and second ink suction ports 12*c* and 12*d* is elongated. Although the distance from the ink feeding port 1*b* to the discharge opening groups 1*f* and 1*g* inclusive of the peripheral parts of the latter is kept unchanged, since the ink suction ports 12*c* and 12*d* are arranged in the vicinity of to the discharge opening groups 1*f* and 1*g*, the difference in ink flow between the central discharge opening group 1*e* inclusive of the peripheral part of the latter and the discharge opening groups 1*f* and 1*g* inclusive of the peripheral parts of the latter is reduced, resulting in ink having an increased viscosity and gas bubbles being uniformly discharged through all the discharge openings. Consequently, a sufficiently acceptable discharge recovering state can be obtained, and moreover, an excellent quality of recorded image can be maintained with the ink jet apparatus.

Figure 14:
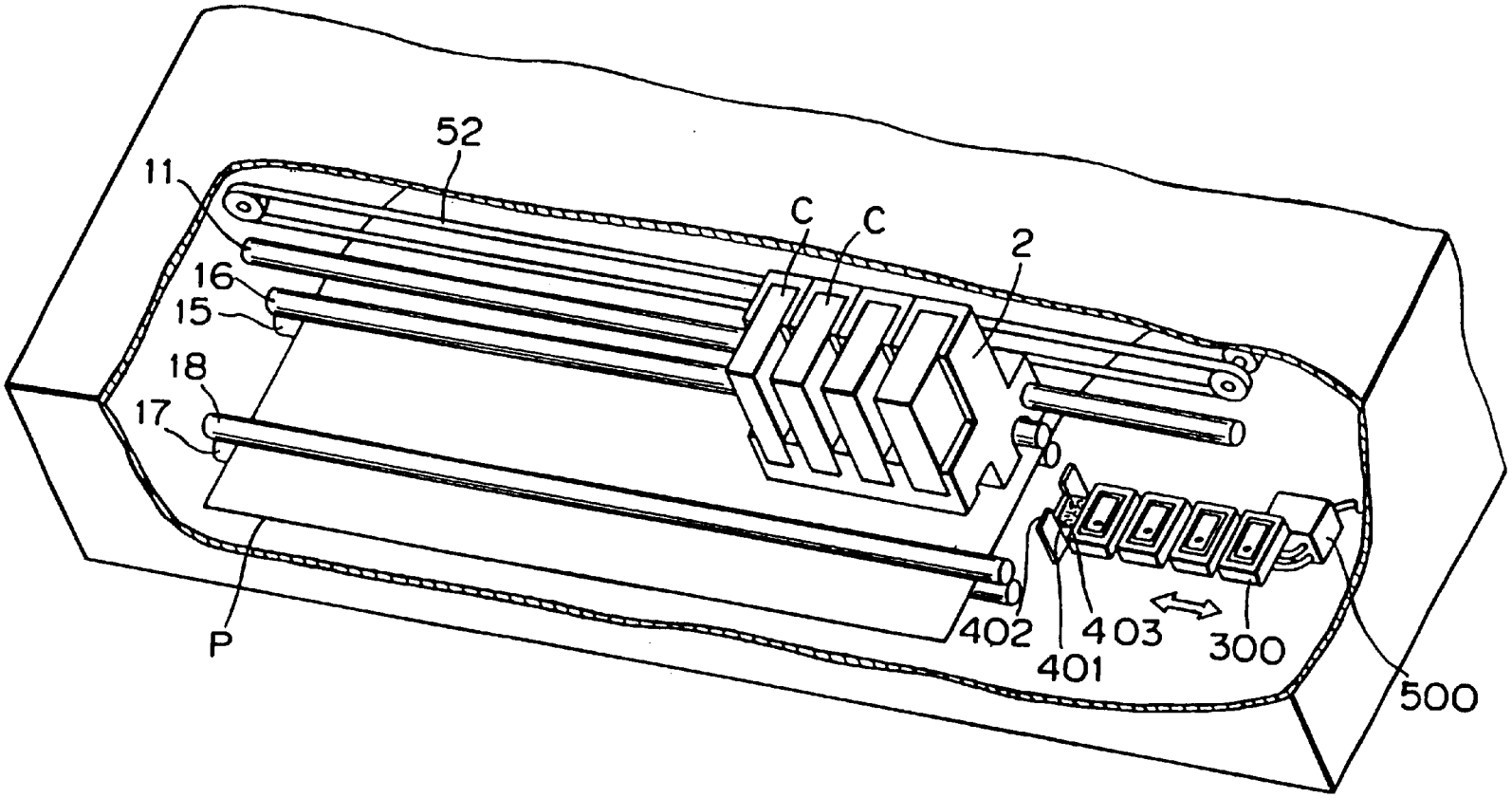
FIG. 14 is a partially exploded perspective view showing the whole structure of a further embodiment of an ink jet apparatus according to the present invention.

Thereafter, the ink jet head and the cap constructed in the above-described manner are incorporated in, e.g., an ink jet apparatus shown in FIG. 14 for the purpose of discharging ink from the ink jet head.

The ink jet apparatus shown in FIG. 14 is a full-colored serial type printer which includes four exchangeable ink jet heads corresponding to four kinds of colored inks, i.e., black (Bk), cyan (C), magenta (M) and yellow (Y). Each of the ink jet heads used for the foregoing printer has a resolution of 400 dpi and a driving frequency of 4 kHz and includes one hundred twenty eight ink discharge openings.

In FIG. 14, reference character C designates four ink jet head cartridges which are arranged corresponding to four kinds of colors represented by Y, M, C and Bk. Each ink jet head cartridge C is constructed such that an ink jet head and an ink tank having ink to be fed to the ink jet head storably received therein are made integral with each other. Each ink jet head cartridge C is detachably mounted on a carriage 2. The carriage 2 is engaged with a guide shaft 11 in such a manner as to slidably move along the guide shaft 11, and moreover, it is fastened to part of a driving belt 52 adapted to be displaced by a main scanning motor (not shown). With this construction, the ink jet head cartridge C can be displaced to perform scanning along the guide shaft 11. Reference numerals 15 and 16 designate conveying rollers arranged on the far side in the recording range defined by the scanning performed by the ink jet head cartridge C, and reference numeral 17 and 18 likewise designate conveying rollers arranged on the near side in the recording range as viewed in the drawing. The conveying rollers 15 to 18 extend substantially in parallel with the guide shaft 11. The conveying rollers 15 to 18 are rotationally driver by an auxiliary scanning motor (not shown) to stepwise convey a recording medium P in the auxiliary scanning direction. As the recording medium F is conveyed, a recording surface is formed on the recording medium P while facing to the ink discharge opening plane defined by the ink jet head cartridges C.

A plurality of units associated with the aforementioned suction recovering treatment are arranged while they are exposed to the movable range of the ink jet head cartridges C located adjacent to the recording range of the same. In FIG. 14, reference numeral 300 designates four capping units which are arranged in the suction recovering system corresponding to the four ink jet head cartridges C each including an ink jet head. As the carriage 2 is displaced by a displacing mechanism (not shown), the capping units 300 can slidably be displaced in the leftward/rightward direction, and moreover, they can be displaced in the upward/downward direction. While the carriage 2 stays at a home position, it is operatively connected to ink jet head portions of the ink jet head cartridges C so as to allow them to be capped with the capping units 300.

Reference numeral 500 designates a pump unit which serves to such ink from ink discharge openings of the ink jet heads inclusive of the peripheral part of the latter via the capping units 300.

[Embodiment 2]

Figure 2:
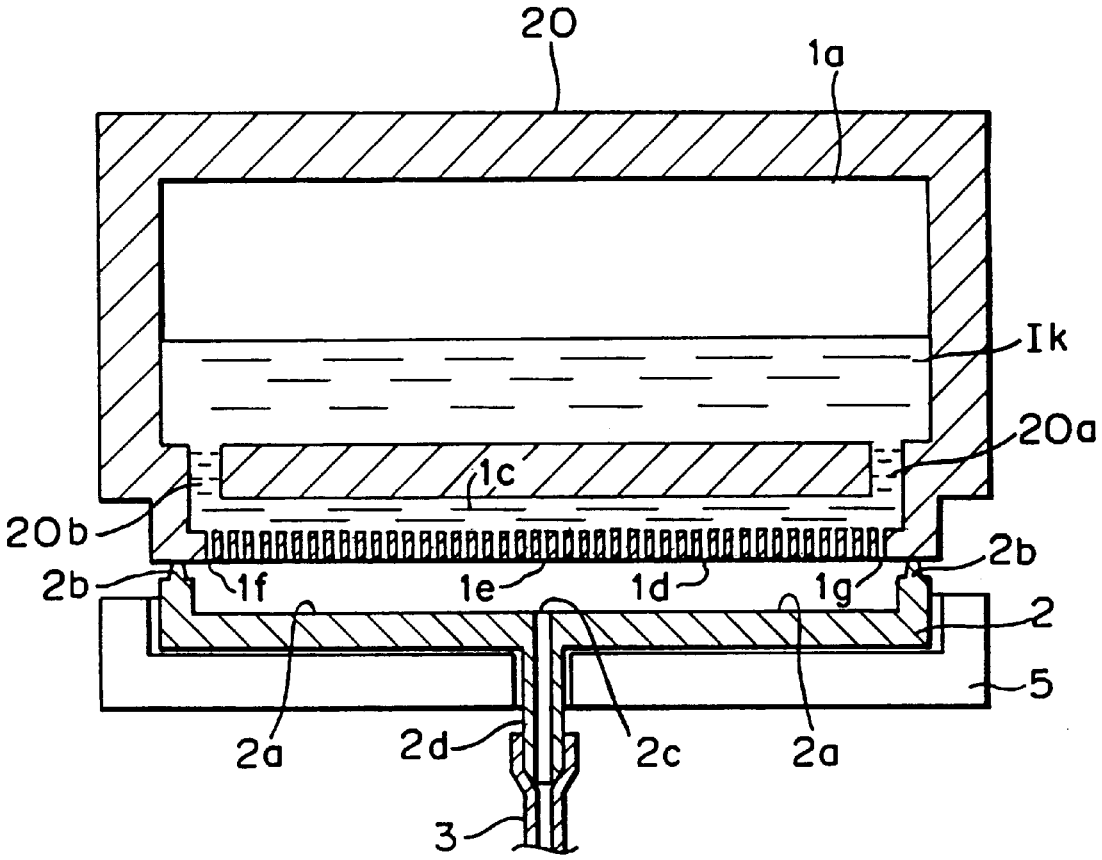
FIG. 2 is a fragmentary sectional view showing an ink jet head and capping means as essential elements of a second embodiment of an ink jet apparatus according to the present invention.

FIG. 2 is a fragmentary sectional view of an ink jet apparatus constructed in accordance with a second embodiment of the present invention, showing the structure of an ink jet head and capping means constituting the ink jet apparatus as essential components.

A characterizing feature of this embodiment consists in that an ink jet head including two ink feeding ports at the predetermined positions is combined with the conventional cap 2 shown in FIG. 12 and FIG. 13. Specifically, in this embodiment, the ink jet head 20 includes a tank portion 1*a* having the substantially same structure as that in Embodiment 1, and a first ink feeding part 20*a* and a second ink feeding port 20*b* are formed through the lower wall of the tank portion 1*a* at the positions facing to a discharge opening group 1*f* and a discharge opening group 1*g* formed in the vicinity of the opposite end edges of a group of ink discharge openings with a common ink chamber 1*c* interposed therebetween.

On the assumption that discharge recovering treatment is conducted with the ink jet head 20 constructed in that way, description will be made below with respect to how ink flows through the respective discharge opening groups.

As is apparent from the drawing, each of the discharge opening group 1*f* and the discharge opening group 1*g* inclusive of the peripheral parts of the latter has a short distance measured from each of the ink feeding ports 20*a* and 20*b* but it has a long distance measured from an ink suction port 2*c*. On the contrary, a central discharge opening group 1*e* inclusive of the peripheral part of the latter has a long distance measured from the ink feeding port 20*a* and the ink feeding port 20*b* but it has a short distance measured from the ink suction port 2*c*. With such construction, the flowing state of ink not only through the discharge opening group 1*f* and the discharge opening group 1*g* inclusive of the peripheral parts of the latter but also through the central discharge opening group 1*e* inclusive of the peripheral part of the latter can be uniformalized.

Also in this embodiment, since ink having an increased viscosity and gas bubbles remaining in each discharge opening can reliably and uniformly be discharged from the whole group of ink discharge ports of the ink jet head 20, a sufficiently acceptable discharge recovering state can be obtained, and moreover, an excellent quality of recorded image can be maintained with the ink jet apparatus.

The ink jet head 20 and the cap 2 constructed in the above-described manner can practically be used like in Embodiment 1 by incorporating them in, e.g., the ink jet apparatus shown in FIG. 14.

[Embodiment 3]

Figure 3:
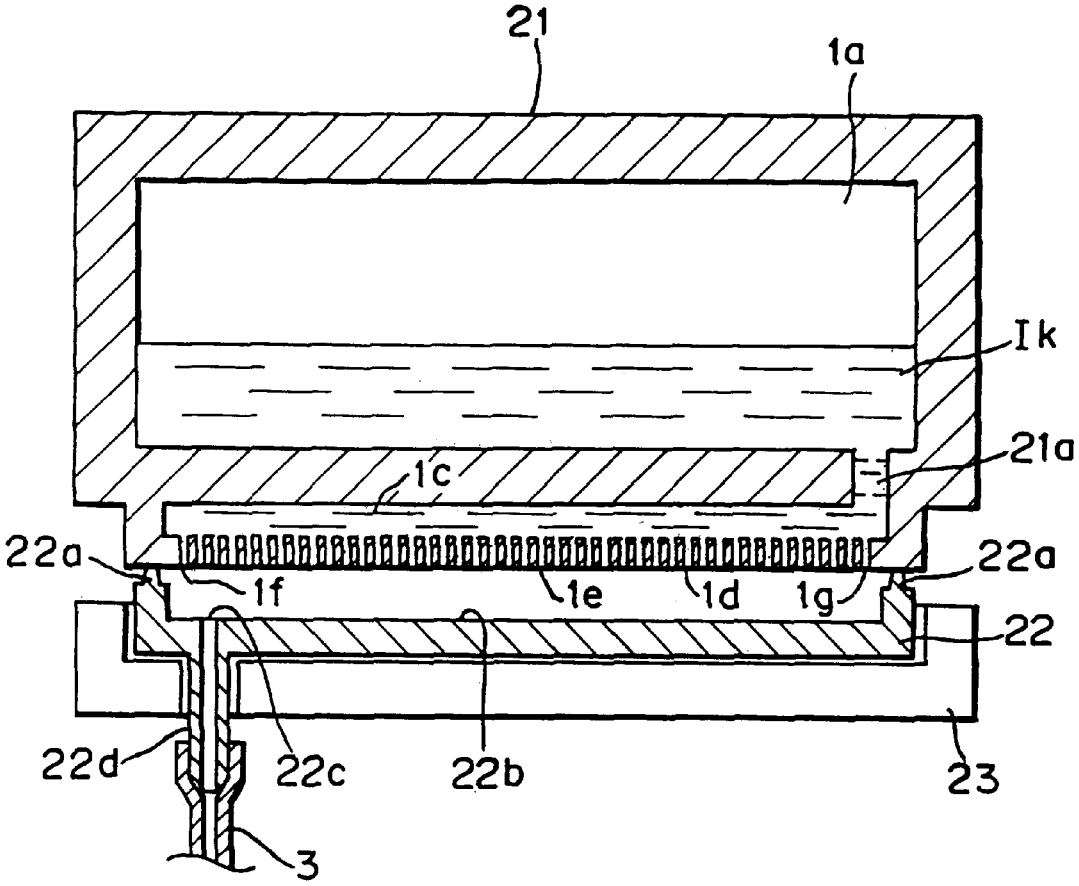
FIG. 3 is a fragmentary sectional view showing an ink jet head and capping means as essential elements of a third embodiment of an ink jet apparatus according to the present invention.

FIG. 3 is a sectional view of an ink jet apparatus constructed in accordance with a third embodiment of the present invention, showing the structure of an ink jet head and capping means constituting the ink jet apparatus as essential components.

A characterizing feature of this embodiment consists in that the position occupied by an ink feeding port of the ink jet head is largely parted away from the position occupied by an ink suction port of the capping means. Specifically, in this embodiment, the ink jet head 21 includes a tank portion 1*a,* and an ink feeding port 21*a* is formed through the lower wall of the tank portion 1*a* at the position facing to a discharge opening group 1*g* on the right-hand end side of a group of ink discharge ports. On the other hand, a cap 22 is molded of an elastic material, and an ink suction port 22*c* is formed on an upper surface 22*b* of the cap 22 at the position facing to a discharge opening groove 1*f* on the left-hand end side of the group of ink suction ports. The ink suction port 22*c* serves as an upper end opening portion of an ink suction pipe 22*d* which suspends from the cap 22, and the ink suction pipe 22*d* is connected to a suction pump (not shown) via a pipe 3.

Next, description will be made below with respect to the flowing of ink in the case that suction recovering treatment is conducted for the ink jet head constructed in that way using the cap 22.

The discharge opening group 1*g* inclusive of the peripheral part of the latter located on the right-hand side as seen in the drawing is spaced away from the ink feeding port 21*a* by a short distance, while it is located remote from the ink suction port 22*c*. In addition, the discharge opening group 1*f* inclusive of the peripheral part of the latter located on the left-hand side is spaced away from the ink feeding port 21*a* by a long distance, while it is spaced away from the ink suction port 22*c* by a short distance. A central discharge opening group 1*e* is arranged in the intermediate positional relationship between both the discharge opening groups 1*f* and 1*g*. With this construction, the flowing of ink in the vicinity of the discharge opening group 1*g* located on the right-hand end side, the central discharge opening group 1*e* located in the intermediate side and the discharge opening group 1*f* located on the left-hand end side can be uniformalized.

Therefore, also in this embodiment, since ink having an increased viscosity and gas bubbles can reliably and uniformly be discharged from the whole group of ink discharge ports of the ink jet head 21, a sufficiently acceptable discharge recovering state can be obtained, and moreover, an excellent quality of recorded image can be maintained with the ink jet apparatus.

In each of Embodiments 1 to 3, in the case that the number of discharge openings of the ink jet head is additionally increased, causing the number of ink feeding ports to be correspondingly increased to three or four, the flowing of ink can be uniformalized over the whole group of discharge openings by forming a plurality of ink suction ports not only at the substantially intermediate position as seen in the direction of arrangement of the respective ink feeding ports of the discharge openings in the cap but also at the opposite ends of the cap.

The ink jet head 21 and the cap 22 constructed in that way can practically be used like in Embodiment 1 by incorporating them in, e.g., the ink jet apparatus shown in FIG. 14.

[Embodiment 4]

Figure 4:
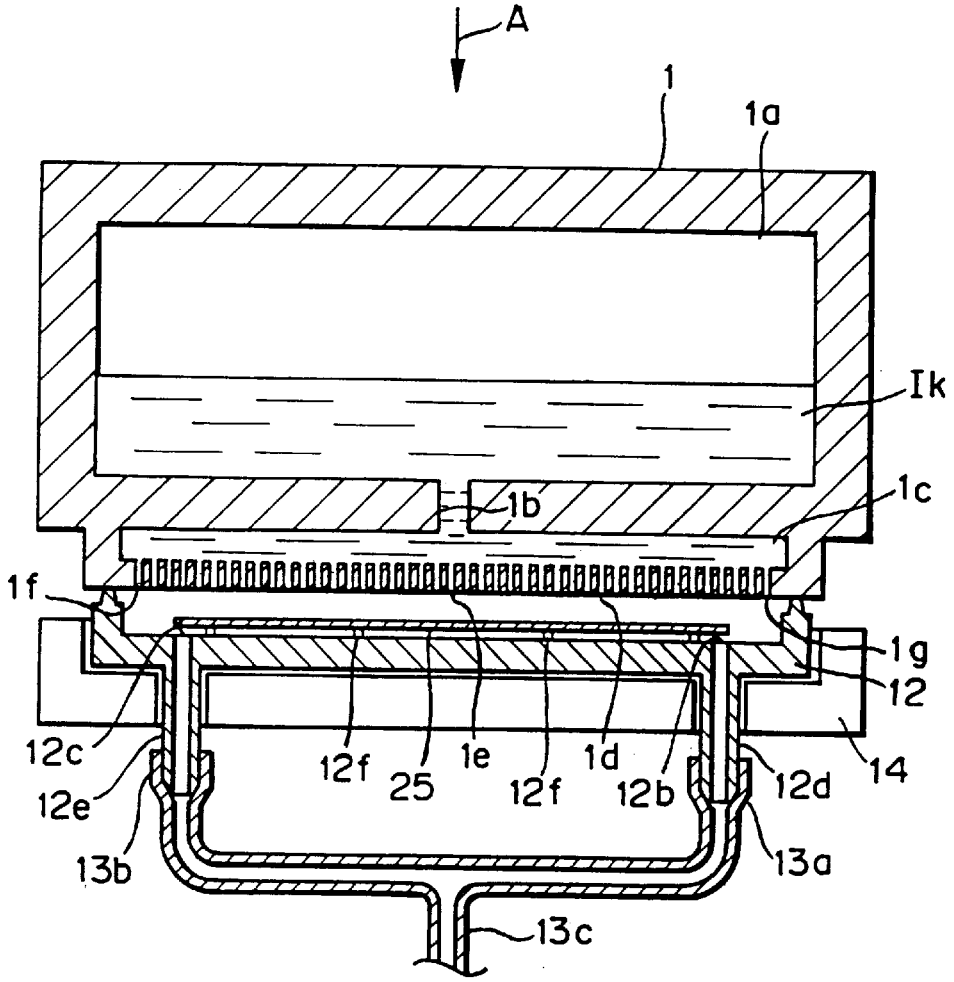
FIG. 4 is a fragmentary sectional view showing an ink jet head and capping means as essential elements of a fourth embodiment of an ink jet apparatus according to the present invention.
Figure 5:
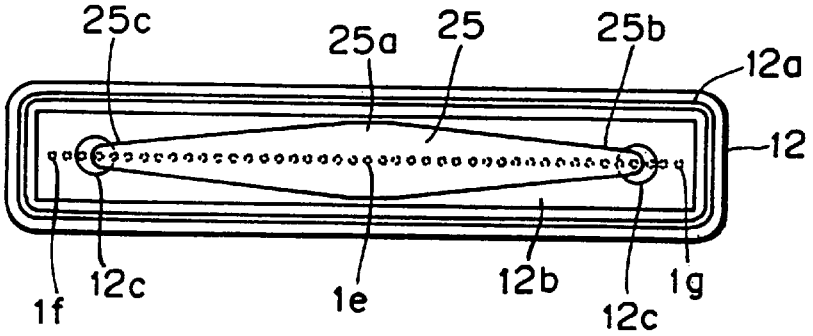
FIG. 5 is a plan view showing the capping means as viewed in the A arrow-marked direction in FIG. 4, showing the state that a series of ink discharge openings formed on the ink jet head are arranged in the overlapped state.

FIG. 4 is a fragmentary sectional view of an ink jet apparatus constructed in accordance with a fourth embodiment of the present invention, showing the structure of an ink jet head and capping means constituting the ink jet apparatus as essential components, and FIG. 5 is a plan view of the capping means as viewed in the A arrow-marked direction in FIG. 4, showing the state that a series of ink discharge openings formed on the ink jet head in the overlapped state.

A characterizing feature of this embodiment consists in that the ink jet apparatus has the substantially same structure as that in Embodiment 1 shown in FIG. 1 and a flow restricting member 25 is arranged on an upper surface 12*b* of a cap 12 for restricting the flowing of ink sucked from respective discharge openings.

The flow restricting member 25 exhibits a substantially rhombic contour and includes a central portion 25*a* having a large width and first and second end portions 25*b* and 25*c* symmetrically located with the central portion 25*a* as a center and each having a small width as viewed in the transverse direction. The intermediate part between the central portion 25*a* and each of the opposite end portions 25*b* and 25*c* is contoured such that a width of the flow restricting member 25 is gradually reduced from the central portion 25*a*.

As shown in FIG. 4, the flow restricting member 25 is placed on a plurality of protuberances 12*f* formed on the upper surface 12*b* of the cap 12, whereby a space capable of being used as an ink flow passage can be formed between the cap 12 and the flow restricting member 25.

Next, description will be made below with respect to the flowing state of ink in the case that discharge recovering treatment is conducted for the ink jet head 1 by using the cap 12 including the flow restricting member 25 constructed in that way.

The flowing state of ink is positively uniformalized depending on the positional relationship established among the respective discharge openings, an ink feeding port 1*b*, and ink suction ports 12*c* and 12*d* in the same manner as described in Embodiment 1. In this embodiment, since the flow restricting member 25 is additionally arranged on the cap 12, the flowing state of ink can more positively be uniformalized owing to the arrangement of the flow restricting member 25. Specifically, as shown in FIG. 5, the flow restricting member 25 is contoured in such a manner that a gap between the flow restricting member 25 and a peripheral wall portion 12*a*, i.e., an inner wall surface of the cap 12 is largely reduced at the central portion 25*a* facing to an ink feeding port 1*b* and the foregoing gap is gradually enlarged toward the opposite end portions 25*b* and 25*c* facing to the ink suction ports 12*c* and 12*d*. With such construction, a large magnitude of resistance against the flowing of ink arises around a central discharge opening group 1*e*, causing the flowing of ink to be suppressed, and a small magnitude of resistance against the flowing of ink arises around discharge opening groups 1*g* and 1*f* on the opposite end sides of the cap 12 without any hindrance against the flowing of ink, whereby the flowing state of ink can additionally be uniformalized by the flow restricting member 25. This embodiment is advantageously applicable especially when the ink jet head 1 is designed in the form of a multi-discharge opening.

The ink jet head 1 and the cap 12 constructed in that way can practically be used like in Embodiment 1 by incorporating them in, e.g., the ink jet apparatus shown in FIG. 14.

[Embodiment 5]

Figure 6:
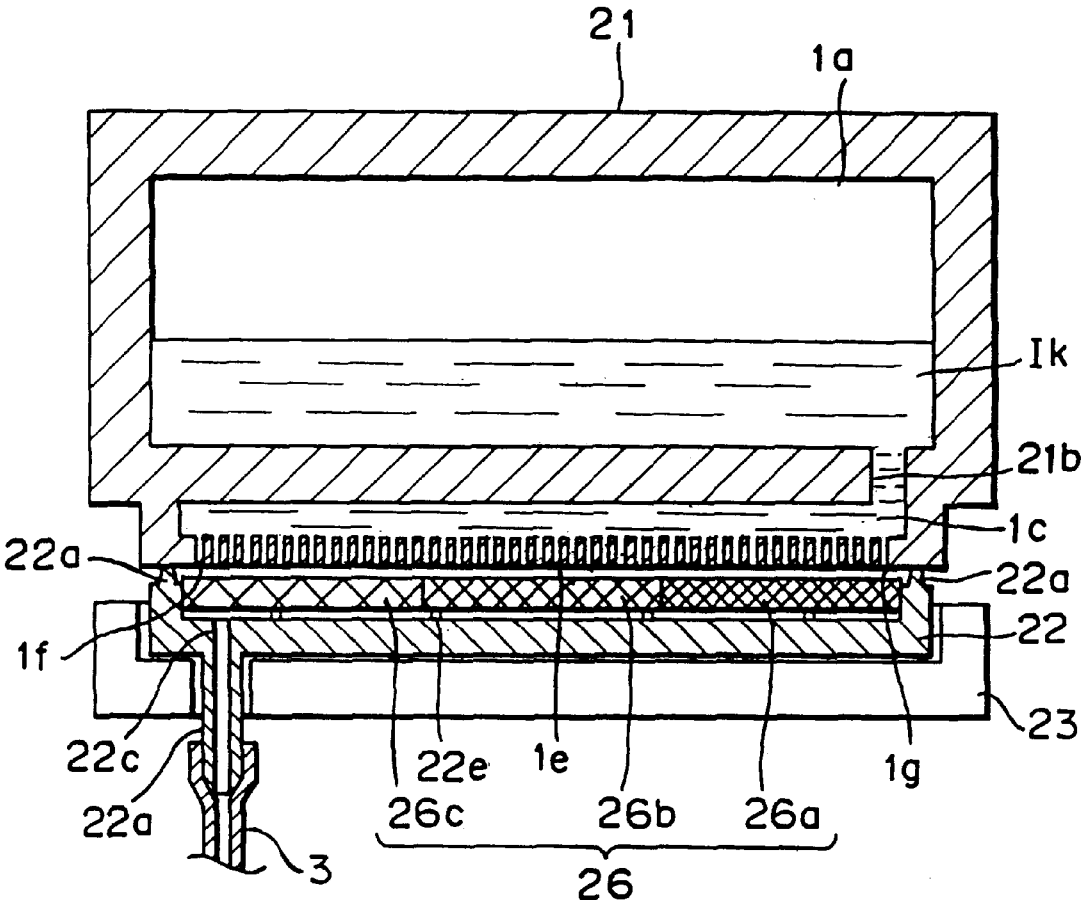
FIG. 6 is a fragmentary sectional view showing an ink jet head and capping means as essential elements of a fifth embodiment of an ink jet apparatus according to the present invention.

FIG. 6 is a fragmentary sectional view of an ink jet apparatus constructed in accordance with a fifth embodiment of the present invention, showing the structure of an ink jet head and capping means constituting the ink jet apparatus as essential components.

A characterizing feature of this embodiment consists in that the ink jet apparatus has the substantially same structure as that in Embodiment 3 shown in FIG. 3 and an ink absorbing member 26 having a special structure is placed on a group of protuberances 22*e* formed on an upper surface 22*b* of a cap 22.

As shown in FIG. 6, the ink absorbing member 26 is composed of a first ink absorbing portion 26*a*, a second ink absorbing portion 26*b* and a third ink absorbing portion 26*c* each having a different density, and these ink absorbing portions 26*a*, 26*b* and 26*c* are integrated with each other to constitute a single ink absorbing member. In this embodiment, the first ink absorbing portion 26*a* facing to an ink feeding port 21*b* has a highest density, and a density of each of the remaining ink absorbing portions is stepwise reduced in accordance with the order of the second ink absorbing portion 26*b* and the third ink absorbing portion 26*c*.

Next, description will be made below with respect to the flowing of ink in the case that discharge recovering treatment is conducted for the ink jet head 21 by using the cap 22 including the ink absorbing member 26 constructed in the above-described manner.

A large magnitude of resistance against the flowing of ink arises around a discharge opening group. 1*g* located on the right-hand end side of the ink jet head 21 due to the presence of the first ink absorbing portion 26*a* having a highest density, i.e., a dense structure, causing the flowing of ink to be suppressed, and a small magnitude of resistance against the flowing of ink arises around a discharge opening group 1*f* on the left-hand end side of the ink jet head 21 due to the presence of the third ink absorbing portion 26 having a lowest density, i.e., a coarse structure without any hindrance against the flowing of ink, whereby the whole flowing state of ink can be uniformalized further in addition to the uniformalization of the flowing of ink attainable by the functional effect based on the structure of the ink jet apparatus in Embodiment 3.

In this embodiment, the ink absorbing member 26 constructed such that three ink absorbing portions each having a different density are integrated with each other to constitute a single ink absorbing member. Alternatively, a plurality of separate ink absorbing portions each having a different density may be arranged one after another on the upper surface 22*b* of the cap 22. This embodiment is advantageously applicable especially when the ink jet head is designed in the form of a multi-discharge opening.

The ink jet head 21 and the cap 22 constructed in the above-described manner can practically be used like in Embodiment 4 by incorporating them in, e.g., the ink jet apparatus shown in FIG. 14.

[Embodiment 6]

Figure 7:
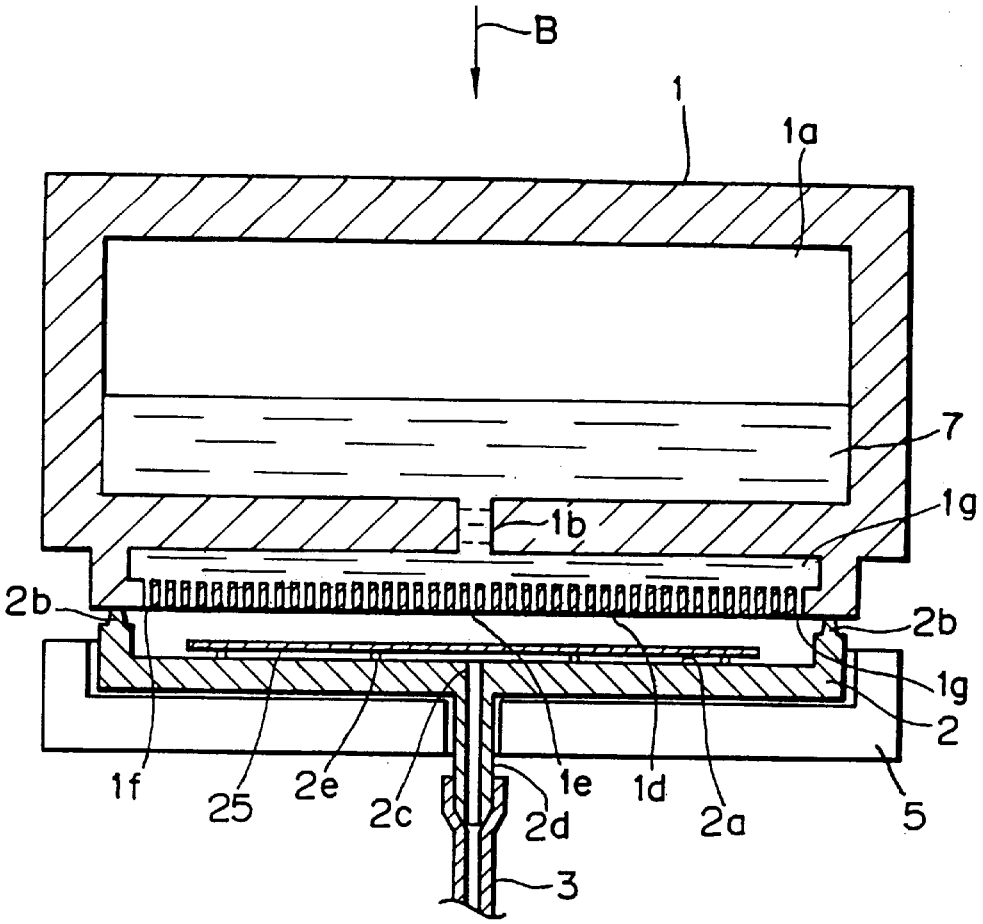
FIG. 7 is a fragmentary sectional view showing an ink jet head and capping means as essential elements of a sixth embodiment of an ink jet apparatus according to the present invention.
Figure 8:
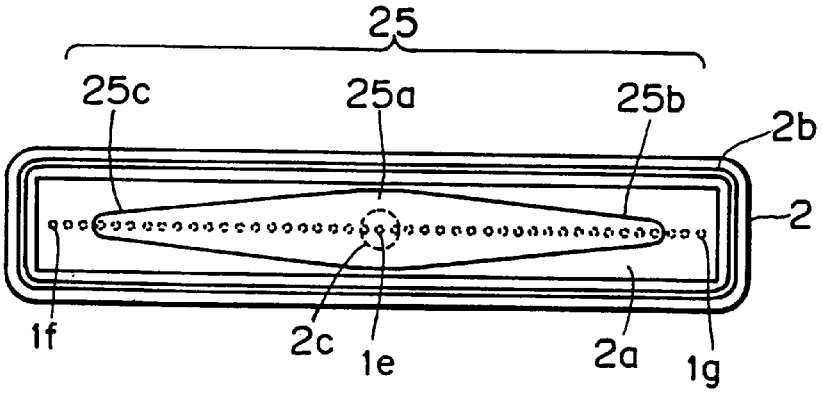
FIG. 8 is a plan view of the capping means as viewed in the B arrow-marked direction in FIG. 7, showing the state that a series of ink discharge openings formed on the ink jet head are arranged in the overlapped state.

FIG. 7 is a fragmentary sectional view of an ink jet apparatus constructed in accordance with a sixth embodiment of the present invention, showing the structure of an ink jet head and capping means constituting the ink jet apparatus as essential components, and FIG. 8 is a plan view of the capping means as viewed in the B arrow-marked direction in FIG. 7, showing the state that a series of ink discharge ports formed on the ink jet head are arranged in the overlapped state.

A characterizing feature of this embodiment consists in that the ink jet apparatus has the substantially same structure as that of the conventional one shown in FIG. 12 and FIG. 13 and a flow restricting member 25 similar to that employed Embodiment 4 shown in FIG. 4 and FIG. 5 is placed on a group of protuberances 2*e* formed on an upper surface 2*a* of a cap 2.

In this embodiment, the flow restricting member 25 causes a large magnitude of resistance against the flowing of ink from a central discharge opening group 1*e* inclusive of the peripheral part of the latter toward an ink suction port 2*c* to arise on the cap 2 with the result that the flowing of ink can be suppressed with the aid of the flow restricting member 25. In addition, the flow restricting member 25 causes a small magnitude of resistance against the flowing ink from discharge opening groups 1*f* and 1*g* located on the opposite end sides of the cap 2 toward an ink suction port 2*c* to arise on the cap 2 without any hindrance against the flowing of ink that way. Consequently, the flowing state of ink can positively be uniformalized with the ink jet apparatus.

The ink jet head 1 and the cap 2 can practically be used like in Embodiment 1 by incorporating them in, e.g., the ink jet apparatus shown in FIG. 14.

[Embodiment 7]

Figure 9:
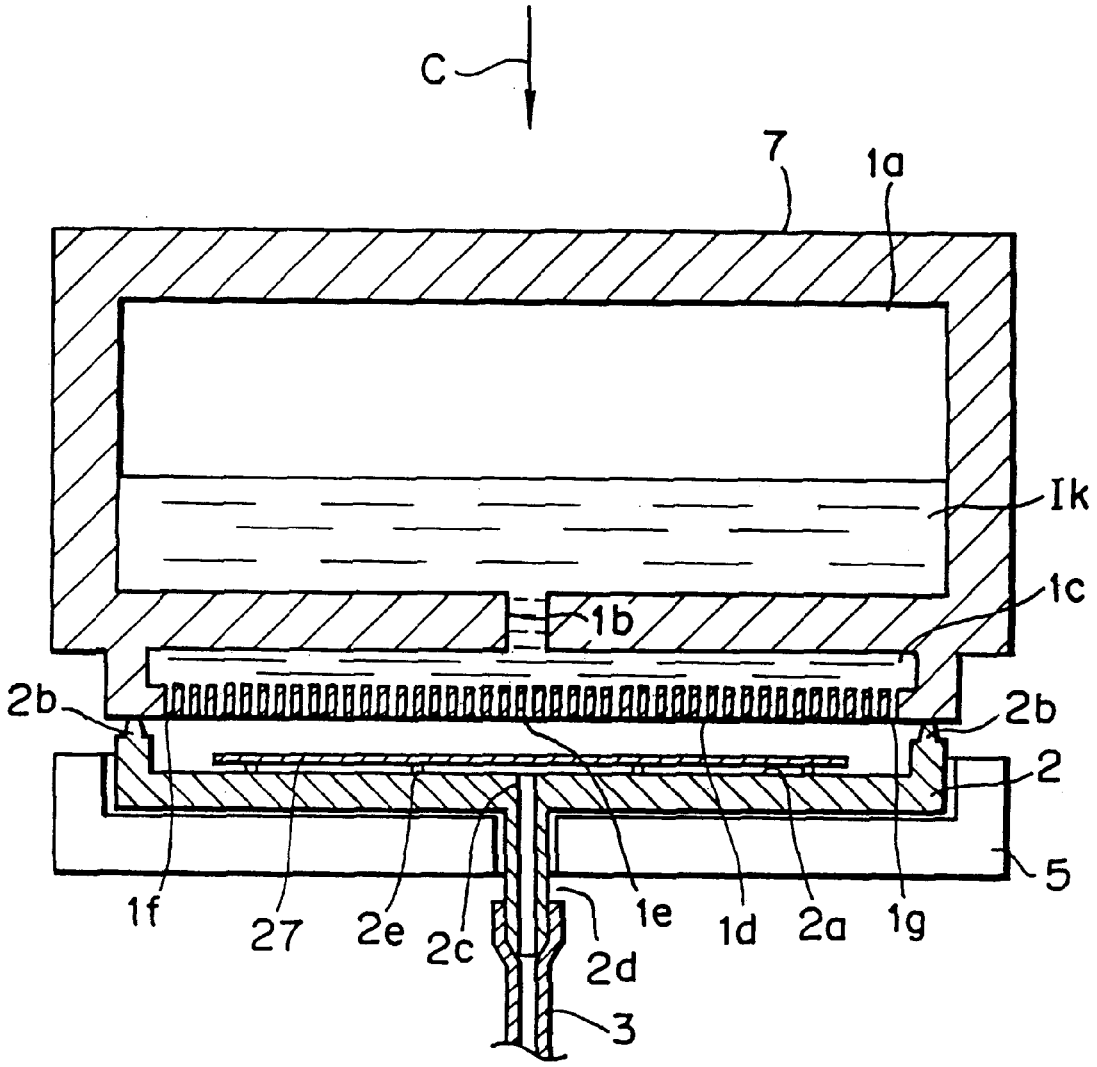
FIG. 9 is a fragmentary sectional view showing an ink jet head and capping means as essential elements of a seventh embodiment of an ink jet apparatus according to the present invention.
Figure 10:
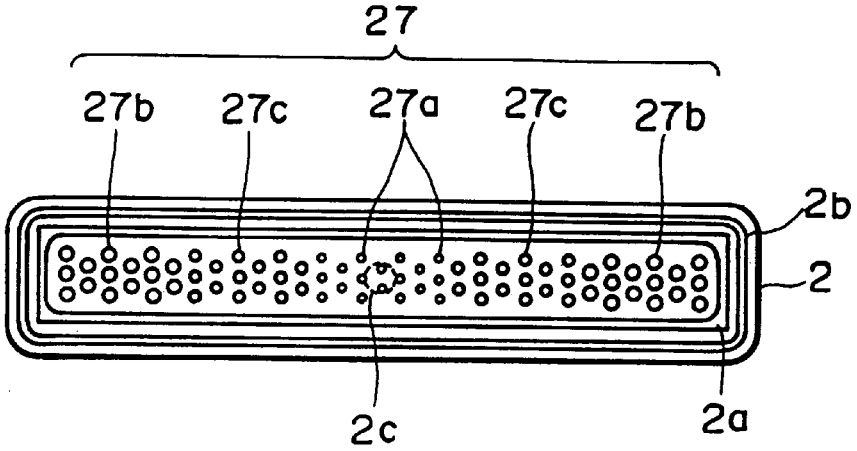
FIG. 10 is a plan view of the capping means as viewed in the C arrow-marked direction in FIG. 9.

FIG. 9 is a fragmentary sectional view of an ink jet apparatus constructed in accordance with a seventh embodiment of the present invention, showing the structure of an ink jet head and capping means constituting the ink jet apparatus as essential components, and FIG. 10 is a plan view of the capping means as viewed in the C arrow-marked direction in FIG. 9.

A characterizing feature of this embodiment consists in that a flow restricting member 27 exhibiting a special contour as shown in FIG. 10 is substituted for the flow restricting member 25 constructed in accordance with Embodiment 6.

In this embodiment, as shown in FIG. 10, the flow restricting member 27 is prepared in the form of a substantially rectangular flat plate. The gap between the flow restricting member 27 and a peripheral wall portion 2*b* of the cap 2 is kept constant along the whole periphery of the flow restricting member 27. A group of holes 27*a* each having a small diameter are formed through the central part of the flow restricting member 27, a group of holes 27*b* each having a diameter larger than that each small hole 27*a* are formed through the opposite end parts of the same, and a group of holes 27*c* each having an intermediate diameter between those of the holes 27*a* and 27*b* are formed through the boundary area between both the holes 27*a* and 27*b*. The holes 27*a* each having a smallest diameter are formed with a large distance between adjacent holes 27*a*, the holes 27*b* each having a largest diameter are formed with a small distance between adjacent holes 27*b*, and the holes 27*c* each having an intermediate diameter are formed with an intermediate distance between those of both the holes 27*a* and 27*c*.

Since the flow restricting member 27 is constructed in the above-described manner, a magnitude of resistance against the flowing of ink from a central discharge opening group 1*e* toward an ink suction ports 2*c* is increased, causing the flowing of ink in that way to be suppressed, and a magnitude of resistance against the flowing of ink from discharge opening groups 1*f* and 1*g* located on the opposite end sides of the flow restricting member 27 toward the ink suction port 2*c* is reduced without any hindrance against the flowing of ink. Consequently, the flowing state of ink can be uniformalized by the flow restricting member 27.

The ink jet head 1 and the cap 2 constructed in that way can practically used like in Embodiment 1 by incorporating them in, e.g., the ink jet apparatus shown in FIG. 14.

[Embodiment 8]

Figure 11:
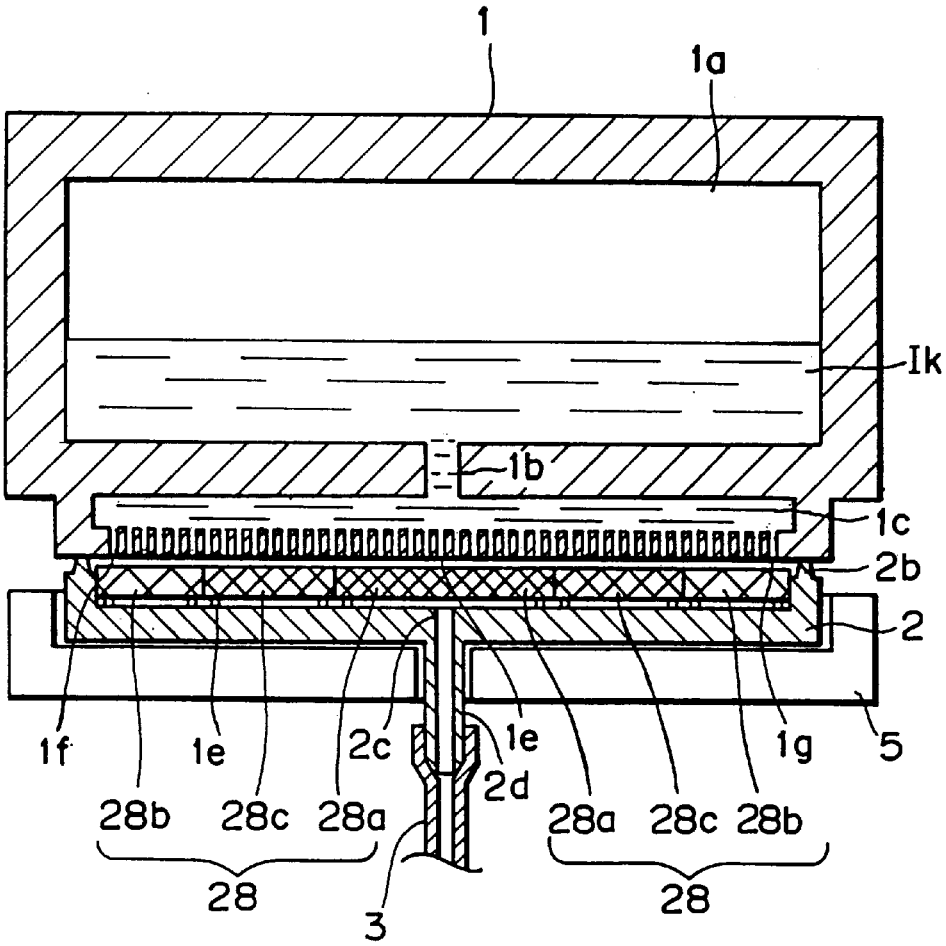
FIG. 11 is a fragmentary sectional view showing an ink jet head and capping means as essential elements of an eighth embodiment of an ink jet apparatus according to the present invention.

FIG. 11 is a fragmentary sectional view of an ink jet apparatus constructed in accordance with an eighth embodiment of the present invention, showing the structure of a recording head and capping means constituting the ink jet apparatus as essential components.

A characterizing feature of this embodiment consists in that the ink jet apparatus has the same structure as that of the conventional one shown in FIG. 12 and FIG. 13 and an ink absorbing member 28 including three kinds of ink absorbing portions each having a different density is placed on a group of protuberances 2*e* formed on an upper surface 2*a* of the cap 2.

The ink absorbing portions of the ink absorbing member 28 constructed in accordance with this embodiment are integrated with each other to constitute a single integral structure. Specifically, the ink absorbing member 28 is substantially composed of a first ink absorbing portion 28*a* arranged at the position facing to a central discharge opening group 1*e* while having a highest foaming density, i.e., a dense structure, second ink absorbing portions 28*b* arranged at the positions facing to discharge opening groups 2*f* and 1*g* on the opposite end sides of the ink jet head 1 with a lowest foaming density, i.e., a coarse structure, and third ink absorbing portions 28*c* arranged between both the ink absorbing portions 28*a* and 28*b* with an intermediate foaming density In this embodiment, a magnitude of resistance against the flowing of ink from an ink feeding port it toward an ink suction port 2*c* is increased, causing the flowing of ink in that way to be suppressed, and magnitude of resistance against the flowing of ink from the ink feeding port 1*b* toward the opposite ends of the cap 2 is reduced without any hindrance against the flowing of ink in this way. Consequently, the flowing state of ink can be uniformalized by the ink absorbing member 28.

In this embodiment, three ink absorbing portions each having a different density are molded integral with each other to constitute the ink absorbing member 28. Alternatively, a plurality of separate ink absorbing portions each having a different density may be arranged one after another for the same purpose as mentioned above.

The ink jet head 1 and the cap 2 constructed in the above-described manner are practically used like in Embodiment 1 by incorporating them in, e.g., the ink jet apparatus shown in FIG. 14.

In each of Embodiment 1 to Embodiment 8, an ink discharging element consisting of a plurality of discharge opening portions and a common ink chamber and an ink tank portion are integrally assembled with each other to constitute an integral unit as an ink jet head. Alternatively, the ink discharging element and the ink tank portion may separately be prepared in such a manner as to allow them to be detachably assembled with each other.

The present invention can be also applied to a called full-line type recording head whose length is not less than the maximum length across a recording medium.

As is apparent from the above description, according to the present invention, the ink jet apparatus is constructed such that an ink suction port of the capping means is formed at a position where an image line connecting the ink suction port with the ink feeding port is crossed with almost all of extending lines along the discharge direction of ink discharged from the ink discharge openings, respectively, and moreover, flow restricting means is arranged in the capping means for reducing a magnitude of resistance against the flowing of ink around the ink suction port compared with a magnitude of resistance against the flowing of ink around the ink feeding port. Thus, a sufficiently acceptable suction recovering state can be obtained over the whole range as seen in the direction of a row of discharge openings by uniformalizing the flowing of ink flowing through the respective discharge openings when negative pressure is applied to the ink jet head during suction recovering treatment, whereby an excellent quality of recorded image can be maintained.

In the case that an ink absorbing member is arranged in the capping means, a density of the ink absorbing member located around the ink suction port is reduced compared with a density of the same around the ink feeding port. Also in the case that the ink feeding port is located opposite to the ink suction port, when flow restricting means is arranged in the capping means for properly adjusting a magnitude of resistance against the flowing of ink around the ink feeding port, the flowing of ink through the respective discharge openings can be uniformalized when negative pressure is applied to the ink jet head during suction recovering treatment, whereby a sufficiently acceptable suction recovering state can be obtained over the whole range as seen in the direction of a row of discharge openings, and moreover, an excellent quality of recorded image can be maintained.

In addition, according to the present invention, since there does not arise a necessity for setting an intensity of suction pressure or a quantity of sucked ink to a level higher than a required one in order to recoverably activate a discharge opening portion having poor flowability, pumping properties of the ink jet apparatus may be degraded with the result that the ink jet apparatus can be designed and constructed with smaller dimensions, and moreover, a quantity of ink to be uselessly wasted can be reduced.

Further, since it is not required that the common ink chamber occupies a large volume in order to reduce a magnitude of resistance against the flowing of ink from the ink feeding port of the ink jet head to the respective discharge openings, the ink jet head can be designed and constructed with smaller dimensions, resulting in the whole ink jet apparatus being designed and constructed with smaller dimensions. Additionally, since a quantity of ink to be sucked during suction recovering treatment can be reduced, a quantity of ink to be uselessly wasted can also be reduced. It should be added that the advantageous effects as mentioned above can remarkably be recognized when the ink jet head is designed in the form of a multi-discharge opening or it is designed with longer dimensions.

The present invention has been described in detail with respect to eight preferred embodiments, and it should of course be understood that changes and modifications may be made without any departure away from the scope of the present invention in its broader aspects, and it is the intention, therefore, in the appended claims to cover all such changes and modifications as fall within the spirit of the present invention.

What is claimed is:

1. An ink jet apparatus, comprising:

capping means for capping a plurality of ink discharge openings of an ink jet head therewith, the ink jet head including the plurality of ink discharge openings to downwardly discharge ink, a common ink chamber communicated with the plurality of ink discharge openings, and an ink feeding port for feeding ink to the common ink chamber;

sucking means for sucking ink from the plurality of ink discharge openings of the ink jet head through an ink suction port while the ink jet head is capped by the capping means, the ink suction port being arranged at a position apart from a position opposing the ink feeding port; and an ink flow restricting means for restricting a flow of the ink by said sucking means through said plurality of discharge openings, a magnitude of restriction against the flow of ink from a given discharge opening being reduced in correspondence to a distance from the given discharge opening to the ink suction port, the ink flow restricting means being arranged in the capping means.

2. An ink jet apparatus, comprising:

capping means for capping a plurality of ink discharge openings of an ink jet head therewith, the ink jet head including the plurality of ink discharge openings to downwardly discharge ink, a common ink chamber communicated with the plurality of ink discharge openings, and an ink feeding port for feeding ink to the common ink chamber;

sucking means for sucking ink from the plurality of ink discharge openings of the ink jet head through an ink suction port while the ink jet head is capped by the capping means, the ink suction port being arranged at a position apart from a position opposing the ink feeding port; and an ink absorbing member for absorbing ink, the ink absorbing member being arranged in the capping means, wherein a density of a given portion of the ink absorbing member increases in proportion to an increase in distance from the given portion to the ink suction port.

3. An ink jet apparatus as claimed in claim 1 or 2, wherein the ink jet head includes an energy generating element for generating energy to be utilized for discharging ink from the plurality of ink discharge openings.

4. An ink jet apparatus as claimed in claim 3, wherein the energy generating element is an electro-thermal converting element for generating thermal energy for allowing a phenomenon of film boiling to appear in ink.

5. An ink jet apparatus as claimed in claim 1 or 2, wherein the plurality of ink discharge openings are arranged in the row-shaped pattern across the whole width of an ink receiving medium to which is ink discharged from the plurality of ink discharge openings.

6. An ink jet apparatus, comprising:

capping means for capping a plurality of ink discharge openings of an ink jet head therewith, the ink jet head including the plurality of ink discharge openings to downwardly discharge ink, a common ink chamber communicated with the plurality of ink discharge openings, and an ink feeding port for feeding ink to the common ink chamber;

sucking means for sucking ink from the plurality of ink discharge openings of the ink jet head through an ink suction port while the ink jet head is capped by the capping means, the ink suction port being arranged at a position where a line connecting the ink suction port with the ink feeding port crosses substantially all of a plurality of lines extending along a discharge direction of ink discharged from the ink discharge openings; and an ink flow restricting means for restricting a flow of ink by said sucking means through said plurality of discharge openings, a magnitude of restriction against the flow of ink from a given discharge opening being reduced in correspondence to a distance from the given discharge opening to the ink suction port, the ink flow restricting means being arranged in the capping means.

7. An ink jet apparatus, comprising:

capping means for capping a plurality of ink discharge openings of an ink jet head therewith, the ink jet head including the plurality of ink discharge openings to downwardly discharge ink, a common ink chamber communicated with the plurality of ink discharge openings, and an ink feeding port for feeding ink to the common ink chamber;

sucking means for sucking ink from the plurality of ink discharge openings of the ink jet head through an ink suction port while the ink jet head is capped by the capping means, the ink suction port being arranged at a position where a line connecting the ink suction port with the ink feeding port crosses substantially all of a plurality of lines extending along a discharge direction of ink discharged from the ink discharge openings; and an ink absorbing member for absorbing ink, the ink absorbing member being analyzed in the capping means, wherein a density of a given portion of the ink absorbing member increases in proportion to an increase in distance from the given portion to the ink suction port.

8. An ink jet apparatus as claimed in claim 6 or 7, wherein the ink jet head includes an energy generating element for generating energy to be utilized for discharging ink from the plurality of ink discharge openings.

9. An ink jet apparatus as claimed in claim 8, wherein the energy generating element is an electro-thermal converting element for generating thermal energy for allowing a phenomenon of film boiling to appear in ink.

10. An ink jet apparatus as claimed in claim 9, wherein the plurality of ink discharge openings are arranged in the row-shaped pattern across the whole width of an ink receiving medium to which ink is discharged from the plurality of ink discharge openings.

11. An ink jet apparatus, comprising:

capping means for capping a plurality of ink discharge openings of an ink jet head therewith, the ink jet head including the plurality of ink discharge openings to downwardly discharge ink, a common ink chamber communicated with the plurality of ink discharge openings, the chamber including an ink feeding port for feeding ink to the common ink chamber;

sucking means for sucking ink from the plurality of ink discharge openings of the ink jet through an ink suction port while the ink jet head is capped by the capping means, the ink suction port being arranged at a position apart from a position opposing to the ink feeding port; and a flow restricting means arranged in the capping means for reducing a magnitude of resistance against the flowing of ink corresponding to the distance from the ink suction port.

12. An ink jet apparatus as claimed in claim 11, wherein the ink jet head includes an energy generation element for generating energy to be utilized for discharging ink from the plurality of ink discharge openings.

13. An ink jet apparatus as claimed in claim 12, wherein the energy generating element is an electro-thermal converting element for generating thermal energy for allowing a phenomenon of film boiling to appear in ink.

14. An ink jet apparatus as claimed in claim 13, wherein the plurality of ink discharge openings are arranged in the row-shaped pattern across the whole width of an ink receiving medium to which ink is discharged from the plurality of ink discharge openings.

15. An ink jet apparatus, comprising:

capping means for capping a plurality of ink discharge openings of an ink jet head therewith, the ink jet head including the plurality of ink discharge openings to downwardly discharge ink, a common ink chamber communicated with the plurality of ink discharge openings, the an ink feeding port for feeding ink to the common ink chamber;

sucking means for sucking ink from the plurality of ink discharge openings of the ink jet head through an ink suction port while the ink jet head is capped by the capping means, the ink suction port being arranged at a position apart from a position opposing to the ink feeding port; and an ink absorbing member for absorbing ink, whose a degree of coarseness being increased in proportion to the distance from the ink suction port.

16. An ink jet apparatus as claimed in claim 15, wherein the ink jet head includes an energy generating element for generating energy to be utilized for discharging ink from the plurality of ink discharge openings.

17. An ink jet apparatus as claimed in claim 16, wherein the energy generating element is an electro-thermal converting element for generating thermal energy for allowing a phenomenon of film boiling to appear in ink.

18. An ink jet apparatus as claimed in claim 17, wherein the plurality of ink discharge openings are arranged in the row-shaped pattern across the whole width of an ink receiving medium to which ink is discharged from the plurality of ink discharge openings.

19. An ink jet apparatus, comprising:

a cap for capping a plurality of ink discharge openings for discharging ink from an ink jet head, said ink jet head including a common ink chamber communicated with said plurality of ink discharge openings and an ink feeding port for feeding ink to said common ink chamber;

sucking means for sucking ink from said plurality of ink discharge openings while said plurality of ink discharge openings are capped by said cap; and an ink flow restricting means arranged in said cap for restricting a flow of ink by said sucking means through said plurality of discharge openings, a magnitude of restriction against the flow of ink from a given discharge opening being reduced in correspondence to a distance from said given discharge opening to said ink feeding port.

20. An ink jet apparatus as claimed in claim 19, wherein said ink flow restricting means comprises an ink absorbing member for absorbing ink, wherein a density of a given portion of said absorbing member is reduced in correspondence to a distance from said given portion to said ink feeding port.

21. An ink jet apparatus, comprising:

a cap for capping a plurality of ink discharge openings for discharging ink;

sucking means for sucking ink from said plurality of ink discharge openings through an ink suction port in said cap while said plurality of ink discharge openings are capped by said cap; and an ink flow restricting means arranged in said cap for restricting a flow of ink by said sucking means through said plurality of discharge openings, a magnitude of restriction against the flow of ink from a given discharge opening being reduced in correspondence to a distance from said given discharge opening to said ink suction port.

22. An ink jet apparatus as claimed in claim 21, wherein said ink flow restricting means comprises an ink absorbing member for absorbing ink, wherein a density of a given portion of said absorbing member is reduced in correspondence to a distance from said given portion to said ink suction port.

23. A cap for capping a plurality of ink discharge openings for discharging ink, provided in an ink jet apparatus comprising sucking means for sucking ink from said plurality of ink discharge openings through an ink suction port in said cap while said plurality of ink discharge openings are capped by said cap, said cap comprising:

an ink flow restricting means arranged in said cap for restricting a flow of ink by said sucking means through said plurality of discharge openings, a magnitude of restriction against the flow of ink from a given discharge opening being reduced in correspondence to a distance from said given discharge opening to said ink suction port.

24. A cap as claimed in claim 23, wherein said ink flow restricting means comprises an ink absorbing member for absorbing ink, wherein a density of a given portion of said absorbing member is reduced in correspondence to a distance from said given to said ink suction port.

* * * * *

UNITED STATES PATENT AND TRADEMARK OFFICE

CERTIFICATE OF CORRECTION

PATENT NO. : 6,017,109
DATED : January 25, 2000
INVENTOR(S) : Yasutsugu Saijo

It is certified that error appears in the above-identified patent and that said Letters Patent is hereby corrected as shown below:

Title page,
At [56], References Cited, U.S. Patent Documents, insert:

| | | | |
|---|---|---|---|
| -- 4,952,947 | 8/1990 | Kyoshima | 347/29 |
| 5,214,447 | 5/1993 | Iwata | 347/30 |
| 5,343,228 | 8/1994 | Takada | 347/29 --. |

At [57], Abstract,
Line 5, "seeding" should read -- feeding --.

Column 1,
Line 10, "a" should be deleted;
Line 11, "kind" should read -- kinds --; and "medium" should read -- mediums --;
Line 17, "system." should read -- systems. --; and
Line 57, "an" should read -- a --.

Column 2,
Line 4, "an" should read -- a --;
Line 26, "serve" should read -- serves --; and
Line 27, "TK" should read --Ik --.

Column 3,
Line 45, "to" should be deleted;
Line 47, "Ink" should read -- ink --; and
Line 52, "can not" should read -- cannot --.

Column 4,
Line 2, "if" should read -- 1f --;
Line 15, "can not" should read -- cannot --;
Line 20, "an moreover, and" should read -- and moreover, an --;
Line 23, "much" should read -- many --; and
Line 40, "inks" should read -- ink, --

Column 6,
Line 7, "the an" should read -- an --;
Line 13, "whose a" should read -- whose --; and
Line 39, "on"should read of --

UNITED STATES PATENT AND TRADEMARK OFFICE

CERTIFICATE OF CORRECTION

PATENT NO. : 6,017,109
DATED : January 25, 2000
INVENTOR(S) : Yasutsugu Saijo

It is certified that error appears in the above-identified patent and that said Letters Patent is hereby corrected as shown below:

Column 7,
Line 24, "link" should read -- ink --;
Line 43, "same" should read -- the same --;
Line 46, "same" should read -- the same --;
Line 51, "to" should be deleted;
Line 54, "to" should be deleted; and
Line 66, "both the" should read -- both --.

Column 8,
Line 63, "numeral" should read -- numerals --; and
Line 67, "driver" should read -- driven --.

Column 9,
Line 23, "such" should read -- suck --; and

Column 10,
Line 10, "in the" should read -- in --.

Column 12,
Line 31, "group." should read -- group --.

Column 13,
Line 4, "employed" should read -- employed in --.

UNITED STATES PATENT AND TRADEMARK OFFICE

CERTIFICATE OF CORRECTION

PATENT NO. : 6,017,109
DATED : January 25, 2000
INVENTOR(S) : Yasutsugu Saijo

It is certified that error appears in the above-identified patent and that said Letters Patent is hereby corrected as shown below:

Column 14,
Line 2, "used" should read -- be used --;
Line 32, "it" should read --1b --; and
Line 58, "called" should read -- so called --.

Column 18,
Line 11, "the" should read -- and --; and
Line 19, "whose a" should read -- whose --.

Column 20,
Line 13, insert -- portion -- after "given".

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*